US005314609A

United States Patent [19]

Stipanovich, Jr. et al.

[11] Patent Number: 5,314,609

[45] Date of Patent: May 24, 1994

[54] PROCESS FOR PREPARING DEBENZOLIZED TAR AND LOW-BENZENE CENTRIFUGED TAR SLUDGE

[75] Inventors: John Stipanovich, Jr., Monroeville; David Q. Wible, North Huntingdon Township, Westmoreland County, both of Pa.

[73] Assignee: Aristech Chemical Corporation, Pittsburgh, Pa.

[21] Appl. No.: 926,204

[22] Filed: Aug. 7, 1992

[51] Int. Cl.[5] ..... C10C 1/04; C10C 1/10; C10C 1/12

[52] U.S. Cl. ..... 208/41; 208/42

[58] Field of Search ..... 208/42, 41

[56] References Cited

U.S. PATENT DOCUMENTS

| | | | |
|---|---|---|---|
| 1,759,816 | 5/1930 | MacCubbin | 208/42 |
| 1,844,896 | 2/1932 | Miller | 208/42 |
| 2,673,833 | 3/1930 | Radasch | 208/42 |
| 2,740,753 | 4/1956 | Schmalenbach | 208/42 |
| 2,851,397 | 9/1958 | Raineau | 208/42 |
| 3,928,169 | 12/1975 | Conroy | 208/42 |
| 4,349,418 | 9/1982 | Belsky et al. | 208/42 |

OTHER PUBLICATIONS

The National Emissions Standards for Hazardous Air Pollutants ("NESHAP"), Part 61, Subpart L promulgated in 1989 (Federal Register, vol. 54, No. 177, pp. 38073 et seq., Sep. 14, 1989).

*Primary Examiner*—Helane Myers
*Attorney, Agent, or Firm*—William L. Krayer

[57] ABSTRACT

Crude coal tar is distilled in the form produced in a coke plant. The distillation tower contains a rectification section to retain naphthalene with the other components heavier than benzene. The benzene is removed overhead.

6 Claims, 1 Drawing Sheet

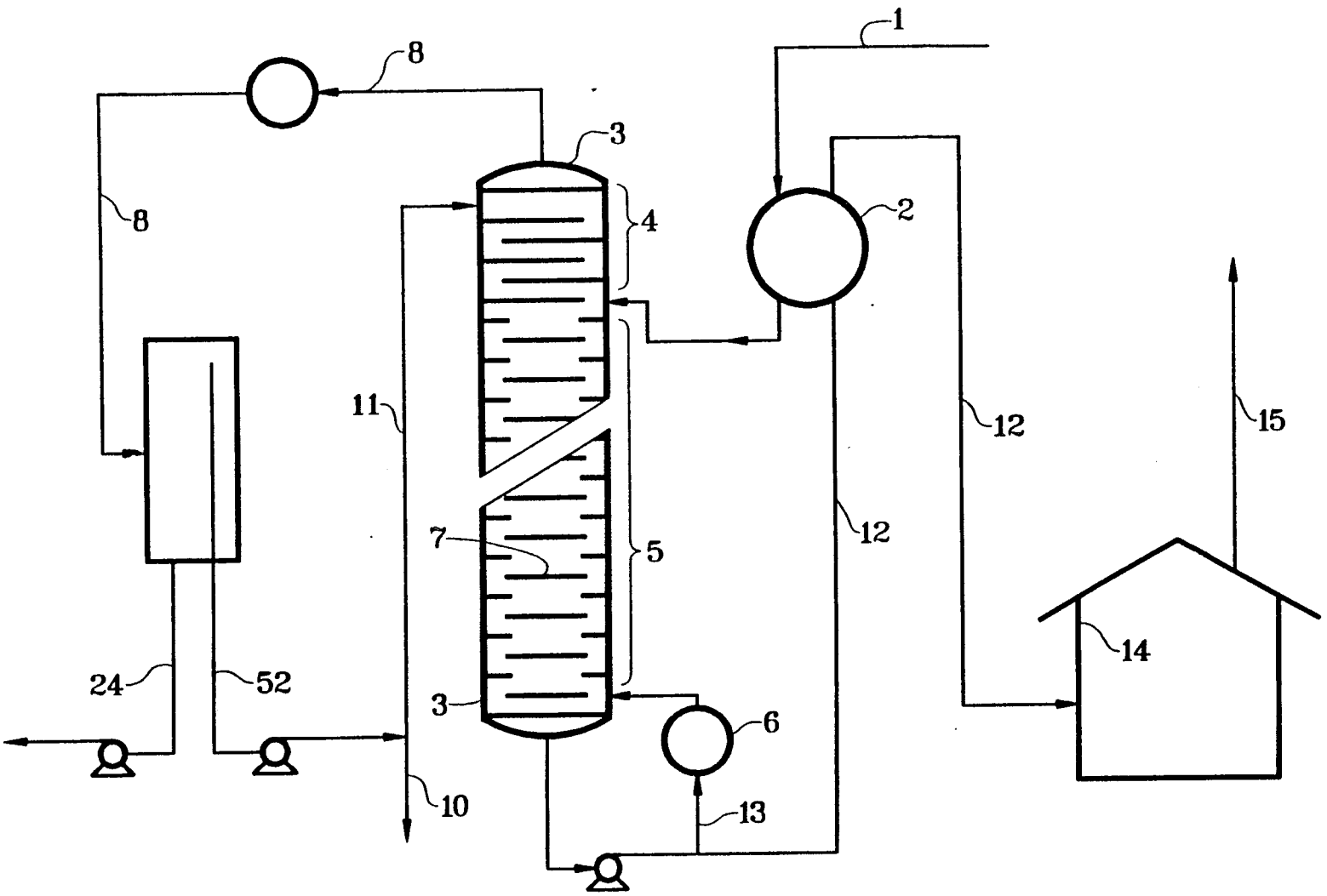
1
2
3
4
5
6
7
8
10
11
12
13
14
15
24
52

PROCESS FOR PREPARING DEBENZOLIZED TAR AND LOW-BENZENE CENTRIFUGED TAR SLUDGE

TECHNICAL FIELD

This invention relates to environmentally improved methods for storing and transporting coal tar. It involves a particular distillation step for the removal of benzene and an optional centrifugation of the resulting low-benzene tar to prepare a sludge which may be used as a fuel because of its low benzene content. The treated tar and sludge each meet separate regulatory standards for benzene content.

BACKGROUND OF THE INVENTION

The National Emissions Standards for Hazardous Air Pollutants ("NESHAP"), Part 61, Subpart L promulgated in 1989 (Federal Register, V. 54, No. 177, p. 38073 et seq., Sep. 14, 1989), decree that all coal tar tanks must be sealed and gas-blanketed because of emissions of benzene which otherwise occur. Exemptions from gas-blanketing may be obtained if alternative methods are demonstrated to reduce benzene emissions from the tanks by 98%. Emissions should not in any event exceed 500 ppm by volume.

The gas-blanketing of tar tanks is expensive both initially and as an on-going enterprise. Regardless of the particular governmental standards, it is recognized that benzene emissions from storage tanks and during transport present a problem which should be addressed. We have therefore invented a practical alternative.

Processing of coal tar of various types is a common practice in the coke making industry. However, the removal of benzene as we perform it is not known to us, and the treatment of coal tar in two stages to make both a low-benzene tar and a low-benzene sludge fuel has not been done to our knowledge.

SUMMARY OF THE INVENTION

We have developed a method of removing benzene from coal tar, generally containing at least about 0.1 wt. % benzene, in an efficient and practical manner so as to obviate the use of gas-blanketing to reduce or eliminate benzene emissions from tanks and transport media. Our process further makes possible the manufacture of a low-benzene fuel which can be used in environments where it would otherwise be prohibited because of high benzene content.

Our method involves distilling crude coal tar as it comes from a coke plant in a distillation column having a rectification section, a stripping section, and a reboiler, and then optionally centrifuging the debenzolated tar to separate the debenzolated tar into a clear fraction and an underflow fraction. Having typically less than 100 ppm benzene, the underflow fraction from the centrifuge, containing significant amounts of small particulate coal, will meet the appropriate criteria for a fuel; centrifuging enables the separation of a "clear" fraction from the tar for further processing into various coal chemicals, as is known in the art.

BRIEF DESCRIPTION OF THE DRAWING

Our invention will be described with reference to the drawing, which is a flow diagram of a preferred variation of the process.

DETAILED DESCRIPTION OF THE DRAWING

In the drawing, crude tar from a coke oven is introduced through line 1 to heater 2 prior to entering the column 3 at the bottom of rectifier section 4, which may be considered the bottom of a rectification section. The purpose of the rectification section is to assure that components slightly or somewhat heavier than benzene will remain with the heavier components of the tar and not be removed with the benzene. Particularly of concern here is naphthalene. The stripping section 5, somewhat longer and below the rectification section 4, is a more or less conventional stripper for removing the relatively light benzene and separating it from the rest of the tar as the material from reboiler 6 proceeds in an upwards direction through the trays 7. Reboiler 6 is also conventional; it redirects its heated material from the bottom of column 3 back into the bottom of column 3, and the more or less conventional trays 7 accomplish their sequential distillation. Benzene and other materials, especially large quantities of water, are removed from the top of the column 3 in line 8 and forwarded to a reflux unit 9 for splitting from line 52 into a light oil stream (in line 10) from which various coke by-product chemicals will be made, and a reflux line 11 which is directed back into the top of the column. Line 24 contains wastewater and lines 12 and 13 direct the bottoms from column 3 into the tar tank 14 which is vented to the atmosphere through line 15.

Optionally, a centrifuge (not shown) may be placed in line 12. The centrifuge is also of more or less conventional design; its purpose is to separate the debenzolated tar in line 12 into a "clear" component relatively clear of coal and coke fines, and a relatively heavy sludge which contains at least about 60% of the coal and coke (ash-bearing) fines. The two products will of course be placed in separate storage. The clear component is better suited to processing for its chemical values, because of the relative absence of ash, and the low benzene content of the sludge (containing no more than about 100 ppm benzene and no less than about 30% by weight material soluble in quinoline) will allow it to be burned as a boiler fuel.

The centrifuging can be conducted in any suitable centrifuge of the type which will cause a separation between the large and small particle size solids materials. A solid-bowl type centrifuge is preferred; an acceleration of at least 1000 times that of the earth's gravity should be achieved.

The viscosity of the coal tar during centrifuging is maintained by controlling the temperature of said coal tar and/or the amount and type of diluent mixed with said coal tar. The viscosity of the coal tar during centrifugation is preferably maintained below about 400 SUS (Saybolt Universal Seconds), and more preferably between about 100 and about 200 SUS. The viscosity of the coal tar during centrifugation may also be controlled by varying temperature. Preferably the coal tar temperature is maintained between about 140° F. and about 325° F., and more preferably between about 200° F. and about 300° F.

The small particle size material generally has an average size of less than about 10 microns, whereas the large particle size solids generally has an average particle size greater than about 10 microns. The speed of the centrifuge, residence time, and other conditions will be varied depending upon the type of coal tar, viscosity of the coal tar, and other characteristics of the coal tar in order to get the desired separation.

EXAMPLE 1

A crude coal tar at 195° F. containing 1.5 wt. % benzene was fed to a distillation column at 90 gpm. The column contained 5 floating valve trays above the feed point and 35 floating valve trays below the feed point. The column temperature at the top was 197° F. and the pressure at the top was 15 psia. Light oil reflux to the top of the column was 1.5 gpm and the reboiler duty at the bottom of the column was 7,000,000 Btu/hr. Debenzolized tar product was taken from the bottom of the column at 300° F. and contained 80 ppm (by weight) benzene.

The debenzolized tar was sent to a storage tank and subsequently fed to a solid-bowl centrifuge at 50 gallons per minute while at a temperature of 205° F. The centrifuge was operated to produce an acceleration 2100 times that of earth's gravity at the bowl wall. The yield of centrate was 96.3 volume %. Analysis of the feed and products are as follows:

| | Ash, wt. % | Quinoline Insolubles, wt. % |
|---|---|---|
| Feed | 0.22 | 8.1 |
| Centrate | 0.08 | 7.2 |
| Underflow | 2.96 | 35.6 |

Two samples of the underflow (sludge) were subjected to the Toxicity Characteristic Leachate Procedure. The extracts contained 0.12 and 0.10 mg/l of benzene, which is below the regulatory limit of 0.5 ng/l contained in the Toxicity Characteristic rule promulgated by the U.S. Environmental Protection Agency on Mar. 29, 1990.

We claim:

1. Method of making a coal tar having less than about 100 ppm of benzene comprising (a) distilling said tar, said distillation characterized by (i) retaining naphthalenes in the tar, (ii) refluxing the light components thereof, (iii) reboiling the heavier components thereof, and (iv) removing benzene therefrom, and (b) recovering a tar having a benzene content less than about 100 ppm.

2. Method of making a substantially debenzolated coal tar and a low benzene fuel tar comprising distilling a coal tar containing at least about 0.1 wt. % benzene to remove benzene therefrom and obtain a debenzolated coal tar having no more than about 100 ppm benzene, passing said debenzolated coal tar to a centrifuge, centrifuging said debenzolated coal tar to separate said debenzolated coal tar into a clear friction relatively free of coal particles and a sludge containing at least 60% of the coal and coke particles in said debenzolated coal tar, and recovering a debenzolated sludge, useful as a fuel, containing no more than 100 ppm benzene and no less than about 30 wt. % of material insoluble in quinoline.

3. Method of claim 2 wherein the viscosity of the coal tar in the centrifuge is maintained below about 400 Saybolt Universal Seconds.

4. Method of claim 2 wherein the centrifuge is operated at an acceleration of at least 1000 times the earth's gravity.

5. Method of claim 2 wherein the temperature of the coal tar during centrifugation is kept between about 140° F. and about 325° F.

6. Method of claim 2 wherein the temperature of the coal tar during centrifugation is between about 200° F. and about 300° F.

* * * * *